US009363855B2

(12) United States Patent
Feri et al.

(10) Patent No.: US 9,363,855 B2
(45) Date of Patent: Jun. 7, 2016

(54) CONTROL SYSTEM FOR CONTROLLING ONE OR MORE CONTROLLABLE DEVICES SOURCES AND METHOD FOR ENABLING SUCH CONTROL

(75) Inventors: Lorenzo Feri, Eindhoven (NL); Tim C. W. Schenk, Eindhoven (NL); Hendricus T. G. M. Penning De Vries, Mierlo (NL); Paulus H. A. Damink, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 623 days.

(21) Appl. No.: 13/142,732

(22) PCT Filed: Dec. 22, 2009

(86) PCT No.: PCT/IB2009/055900

§ 371 (c)(1),
(2), (4) Date: Jun. 29, 2011

(87) PCT Pub. No.: WO2010/079400

PCT Pub. Date: Jul. 15, 2010

(65) Prior Publication Data

US 2011/0276151 A1 Nov. 10, 2011

(30) Foreign Application Priority Data

Jan. 6, 2009 (EP) ..... 09150105

(51) Int. Cl.
*H05B 33/08* (2006.01)
*H05B 37/02* (2006.01)

(52) U.S. Cl.
CPC ..... *H05B 33/0803* (2013.01); *H05B 37/029* (2013.01); *H05B 37/0272* (2013.01)

(58) Field of Classification Search
USPC ..... 700/19
See application file for complete search history.

(56) References Cited

U.S. PATENT DOCUMENTS 7,242,152 B2 * 7/2007 Dowling et al. ..... 315/291
2003/0057887 A1 3/2003 Dowling et al.

FOREIGN PATENT DOCUMENTS

CN 101164382 A 4/2008
WO 2006111930 A2 10/2006
WO 2007052197 A1 5/2007
WO 2007072285 A1 6/2007
WO 2007125477 A2 11/2007

(Continued)

OTHER PUBLICATIONS

Brumitt et al. ""Let There Be Light!". Comparing Interfaces for Homes of the Future", Technical Report MSR-TR-2000-92, Microsoft Corporation, Sep. 2000 (hereinafter Brumitt).*

*Primary Examiner* — Carlos Ortiz Rodriguez
(74) *Attorney, Agent, or Firm* — Meenakshy Chakravorty

(57) ABSTRACT

The invention relates to control system configured for controlling at least one controllable device. The device has been assigned a corresponding identifier and is configured for transmitting an identification signal comprising the identifier of the device. The control system comprises a display for displaying a control item configured for controlling the controllable device. The control system also comprises a receiver configured for wirelessly receiving the identification signal comprising the identifier. The control system is configured for assigning a position of the control item on the display to the device identified by means of said received identifier.

12 Claims, 5 Drawing Sheets

(56) References Cited

FOREIGN PATENT DOCUMENTS

| | | | |
|---|---|---|---|
| WO | 2007132382 | A2 | 11/2007 |
| WO | 2008001262 | A1 | 1/2008 |
| WO | 2008038188 | A2 | 4/2008 |
| WO | 2008047281 | A2 | 4/2008 |

* cited by examiner

CONTROL SYSTEM FOR CONTROLLING ONE OR MORE CONTROLLABLE DEVICES SOURCES AND METHOD FOR ENABLING SUCH CONTROL

FIELD OF THE INVENTION

The invention relates to the field of control of one or more controllable devices, in particular illumination sources in an illumination system. More specifically, the invention relates to the field of enabling a user, after one or more tangible devices have been installed, to control these devices in an intuitive and easy manner as desired by the user.

BACKGROUND OF THE INVENTION

Remote control of a variety of types of devices has become commonplace technology during the last decades. Well known examples include audiovisual devices, such as televisions and disc players. Many more devices can be configured for being remotely controllable, including doors and curtains.

A specifically interesting area of remotely controllable devices relates to illumination sources.

Light design is an art and, as such, it relies on the creativity of a user or light designer. This process cannot be substituted by electronic means, but largely depends on the creativity and knowledge of the user or light designer.

The ideation phase, during which the light scene is created in the mind and in the plans of the user or designer, is followed by the installation phase when the light infrastructure comprising illumination sources is put in place. Finally the mapping phase comes, during which the user or light designer ports the planned light scene or lightconcepts into the physical infrastructure. This is a critically important phase since it represents the bridge between the ideation of the user or designer and user or customer fruition.

Nowadays, the mapping takes place by means of the light user operating complex control panels that give access to all the devices (i.e. illumination sources) installed in the light infrastructure.

The mapping performed with the currently available tools is a very cumbersome task. A typical illumination infrastructure comprises at least ten illumination sources. In fact, the user or light designer has imagined the light scenes in terms of spaces and illumination, but all it has under control is a control panel full of a large number of (digital, if implemented in software) levers. The interaction with the light scene is not intuitive, since first of all the mapping between the knobs and the illumination sources is not directly clear and has to be figured out. Also, it is hard to judge the impact of changing the setting of one of the buttons, when standing at the fixed control position, since the impact from different sides might be quite different.

SUMMARY OF THE INVENTION

It is an object of the present invention to provide a control system and method allowing a better and more intuitive control of an illumination infrastructure.

A control system configured for controlling at least one controllable device is disclosed. The device has been assigned a corresponding identifier and is configured for transmitting an identification signal comprising the identifier of the device. The control system comprises a display for displaying a control item configured for controlling the controllable device. The control system also comprises a receiver configured for wirelessly receiving the identification signal comprising the identifier. The control system is configured for assigning a position of the control item on the display to the device identified by means of said received identifier.

Also, a method of enabling controlling at least one controllable device using a control system is disclosed. The device has been assigned a corresponding identifier and is configured for transmitting an identification signal comprising the identifier of the device. The identifier of the device is received and a position of a control item on a display is assigned to the thus identified device. The control item is displayed on the assigned position of the display. The control item is configured for enabling control of the controllable device.

A computer program product or collection of products configured for performing this method is also disclosed.

The at least one controllable device may be a component of an illumination infrastructure, such as an illumination source, a device comprising a plurality of such sources or a controller (e.g. a switch or a display) configured for controlling such an illumination device or devices.

The identifier of the device may be communicated from each device separately to the control system, using e.g. light (IR, visible light) or sound (ultrasound).

The control system may be a single portable device comprising an integrated receiver. The receiver may comprise one or more image sensors (e.g. a camera) for obtaining the identifier(s) of the device(s).

The control system and method allow the identified device to be paired with a control item for controlling this device and to position this control item on an intuitive position on the display of the control system. The user may easily find the control item associated with the device desired to be controlled and subsequently control the device through the control item.

The embodiments of the invention as defined in claims 2 and 9 allow a user or designer to place the control item at a desired position on the display. The user may e.g. select a device by pointing the receiver to the device (e.g. by pointing an image sensor to a light source) to isolate this device. The control system would then receive the identifier of the device and the user or designer would subsequently be able to select a position on the display for the control item of the thus identified device. Other (control) features of the device can be added manually or automatically for the control item, e.g. control features for controlling the direction, beam shape, intensity, colour etc of an illumination source.

The embodiments of the invention as defined in claims 3 and 10 allow the user to select one or more devices at once by pointing the receiver to these devices. The control system is configured for determining the relative positions of the devices in the receiving field of the receiver and to determine the identifiers of each of these devices. Subsequently, the control items are positioned on the display in accordance with the determined relative positions of the devices to obtain a control display wherein the control items are automatically provided on positions where the user/designer expects them.

The embodiments of claims 4 and 11 enable display of control items on the display at or near an image of the devices (e.g. obtained by taking a snap shot of a room) to further clarify for a user/designer which control item should be operated to control a particular (group of) device(s).

The embodiments of claims 5 and 12 enable transmission of the identifier of an illumination source by embedding this identifier in the visible light emitted by the illumination source for illumination purposes. The embedding of the identifier can be performed by modulating the visible light in a manner invisible for the user but detectable by the receiver.

The modulated light may be used to convey further (control and/or status) information of the illumination source.

It should, however, be appreciated that the device may also comprise a dedicated transmission element, e.g. an infrared light source, an rf source or an ultrasound source, in order to transmit the identifier and, possibly, the control and/or status information to the control system. The receiver of the control device is configured for receiving such identification signals.

In view of the bandwidth limitations of the direct channel between the device(s) and the control system (e.g. if the visible light of an illumination source is used), preferably only the device identifier is obtained directly from the device itself, whereas other information is retrieved using the identifier (or a derivative thereof) as a key or index for retrieving this information, as defined in the embodiments of claims 6 and 13.

Since the direct channels between the control system and the devices may not be bidirectional, the embodiments of claims 7 and 14 provide for a central means configured for receiving control commands and, possibly after processing, provide control commands to the devices in accordance with the operation of the control item on the display of the control system. In an embodiment, a unidirectional light channel is used for communicating the identifier of the device, whereas a bidirectional rf channel is used for actually controlling the device.

A particularly advantageous application of the invention is in the field of illumination infrastructures in buildings or other spaces. For example, the control system may be used for controlling one or more controllable illumination sources configured for emitting light to obtain a light scene in the building or space. Each of the illumination sources is identified by an identifier that can be registered by the control system using one or more image sensors (e.g. a camera) as the receiver. Preferably the identifier is obtained from the light emitted by the illumination sources itself. The control system comprises a display. The control system is configured for providing a user interface on the display. The control system is further configured for generating a scene image and a control image. The scene image is obtained via the receiver and may comprise an image of the illumination sources and/or an image of the light emitted by these sources. The control image contains the control items and possibly further control information of one or more of the identified illumination sources. The user interface comprises a combined image of the scene image and the control image, wherein control items are positioned on the user interface in dependence of the positions of the illumination sources and/or the light emitted by these sources in the scene image such that the control items and the illumination sources are paired.

In this manner, it is intuitively clear for a user/designer which control item should be operated for controlling a particular (group of) illumination source(s) in order to obtain a desired light scene. The display showing the real scene image of the illumination source and/or the emitted light thereof in combination with the control image, preferably in an overlaid fashion, enables the user/designer to intuitively control the illumination infrastructure. The scene image and the control image are linked via the identifiers of the illumination sources. The control image provides direct insight of the control options of the individual illumination sources for adapting the light scene. The scene image may provide immediate feedback on the result of controlling the illumination sources.

It should be noted that the linking of the areas within the light scene with the control information does not necessarily imply that the control information is provided in the user interface on top of such an area. Other variants have been envisaged, including the use of connection lines, colour, menu's etc.

It should be appreciated that the control image may comprise one or more selectable shortcuts as control information, wherein the shortcuts are configured for providing further control options upon selection of these short-cuts. In this manner, the control information hides little of the scene image if control of a particular illumination source is not desired, while the control information for controlling the illumination source remains easily accessible.

Hereinafter, embodiments of the invention will be described in further detail. It should be appreciated, however, that these embodiments may not be construed as limiting the scope of protection for the present invention.

DETAILED DESCRIPTION OF THE DRAWINGS

Figure 1B:
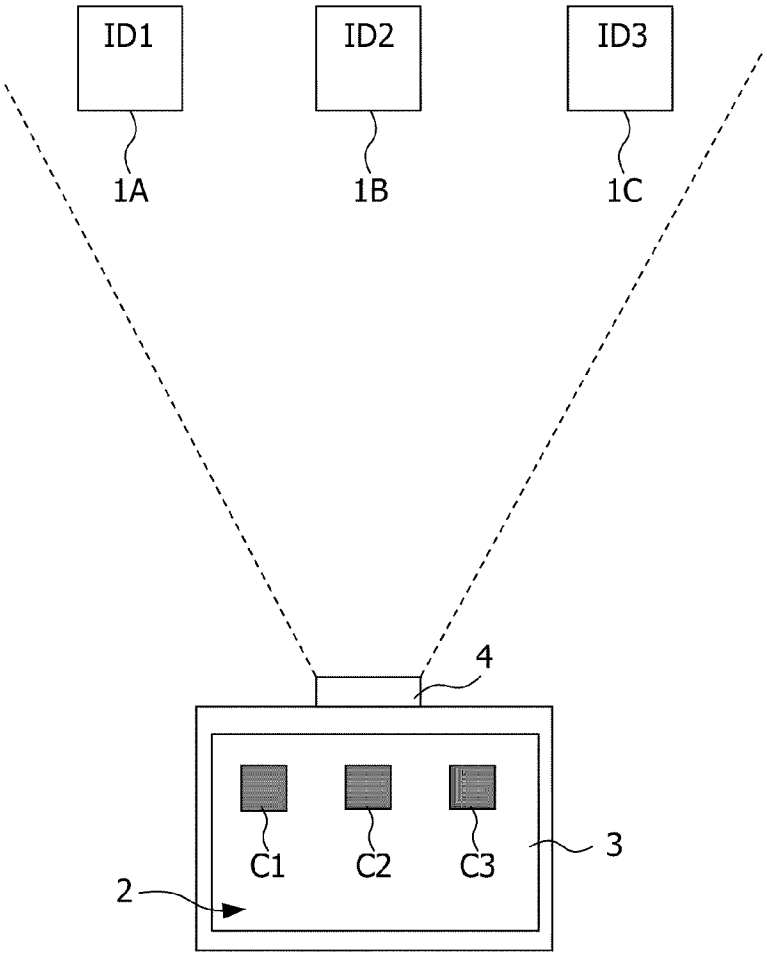
FIGS. 1A and 1B are schematic illustrations of a system comprising a device configuration and a control system according to embodiments of the invention.
Figure 1A:
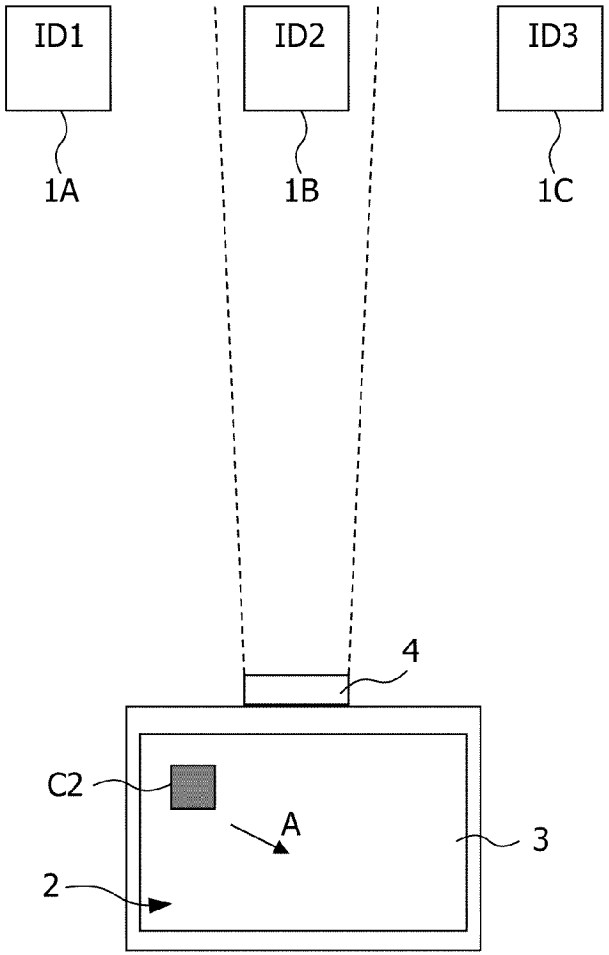

FIGS. 1A and 1B are schematic illustrations of a system comprising controllable devices 1A, 1B, 1C each being identified by means of identifiers ID1, ID2, ID3 and configured for transmitting identification signals comprising this identifier to an external system. Devices 1A, 1B, 1C may be similar or different devices, such as illumination sources or curtains.

A control device 2 is provided for controlling the controllable devices 1A, 1B, 1C. Control device 2 preferably is a portable device (e.g. a laptop computer, a remote control, a portable communication device, such as a mobile phone, a PDA or other handheld device) comprising a display 3 capable of displaying one or more control items C. Control items C can be operated directly on the display using a touch screen or by operating peripheral equipment, such as a key board, a mouse or other operating means.

The control device 2 comprises a receiver 4 configured for receiving the identification signals from controllable devices 1A-1C. Identification signals may comprise (ultra)sound signals or light signals, using e.g. an infra-red light emitting diode provided on the controllable device. The receiver may comprise one or more image sensors (e.g. a camera) for obtaining the identifier(s) of the device(s).

Control system 2 comprises storage means and a processor (not shown) arranged to store and run computer programs in a manner known to a person skilled in the art. Control system 2 is provided with one or more computer programs capable of obtaining the functionality described below.

The control system 2 is configured for assigning a position of a control item C1-C3 on the display 3 to a device 1A-1C that is identified by means of the identifier ID1-ID3. The control system allows the identified device(s) 1A-1C to be paired with the control item(s) C1-C3 C for controlling these devices and to position this control item(s) C1-C3 C on an intuitive position on the display 3 of the control system 2. The user may easily find the control item associated with the device 1A-1C desired to be controlled and subsequently control the device 1A-1C through the control item C1-C3.

In the embodiment of FIG. 1A, the receiver 4 is directed into the direction of device 1B to isolate and receive the identification signal of device 1B comprising ID2. A control item C2 is paired to device 1B by means of the identifier ID2. The position of control item C2 assigned device 1B can be selected by the user, as indicated by the arrow A. Control item C2 comprises or retrieves further control attributes enabling control of the device 1B. Further control information and/or attributes may also be added manually by the user.

In the embodiment of FIG. 1B, the field of view of the receiver 4 is such that the identification signal of multiple devices 1A-1C can be received and the relative positions (e.g. the distribution of the devices 1A-1C) can be determined. Control system 2 is configured such that the positions of control items C1-C3 on the display 3 are assigned to devices 1A-1C in dependence of the determined relative positions of these devices, wherein separate devices are distinguished by means of the identifier ID1-ID3.

Control items C1-C3 may be present on the display 3 prior to receiving and processing the identification signal or may be generated in response to receiving the identification signal.

As mentioned above, a particularly advantageous application of the control system 2 is in the control of an illumination infrastructure. Hereafter, such an application will be described in further detail.

Figure 2:
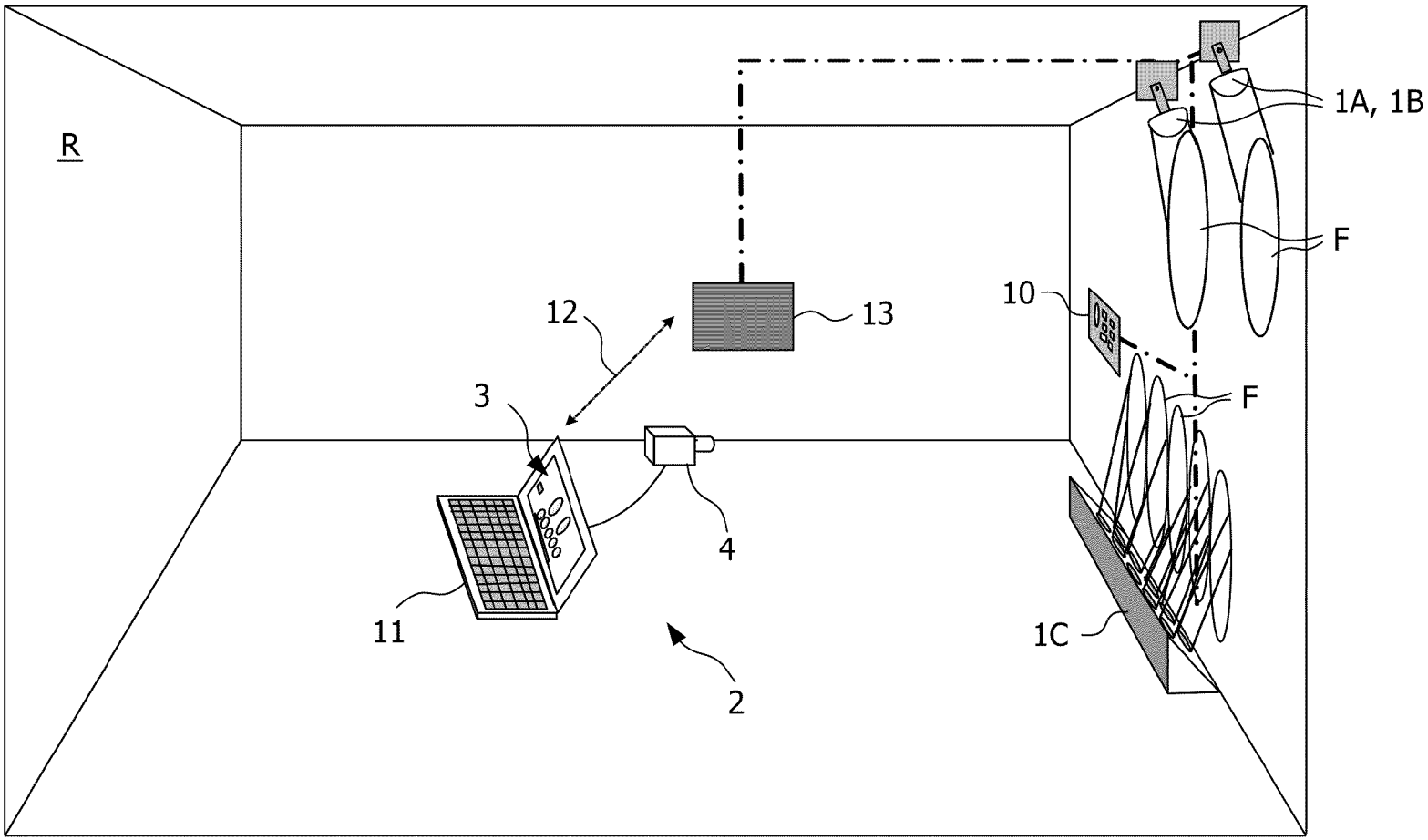
FIG. 2 is a schematic illustration of a room provided with an illumination infrastructure to be controlled using a control system according to an embodiment of the invention.

FIG. 2 is a schematic illustration of a room R provided with an illumination infrastructure comprising a plurality of illumination sources 1A, 1B, 1C and a control device 10. Control device 10 enables manual control (e.g. on/off, steering, programming etc.) for each of the illumination sources 1A-1C. Control device 10 may comprise a touch screen with control items C, as will be explained in further detail below.

In the example of FIG. 2, the illumination infrastructure comprises two steerable spotlights 1A, 1B arranged at the ceiling of room R and lighting fixture 1C comprising a plurality of light sources provided at the floor of room R. These light sources may be controlled separately.

The illumination sources 1A-1C emit light to a side wall of room R such that a light scene is obtained consisting of one or more footprints or illumination areas F of each of the illumination sources 1A-1C.

When the illumination infrastructure has been installed, a designer may use a control system 2 as illustrated in FIG. 2 to control one or more components of the illumination infrastructure in order to obtain an intended light scene.

Control system 2 comprises a portable computer device 11, a laptop, and an image sensor array 4 operating as a receiver, in the present embodiment a camera. It should be noted that image sensor array 4 is not necessarily a separate component of the control system 2, but may be integrated in the computer device 11. It should also be noted that a few image sensors (e.g. three) may be sufficient for receiving an identifier of an illumination source 1A-1C. Computer device 11 comprises a display 3 for providing a user interface, described in more detail with reference to FIG. 4, enabling control of the illumination sources 1A-1C and control device 10 using control items.

Control of the illumination sources 1A-1C and control device 10 may be achieved using control items C (see FIGS. 3B and 4) by operating keys on the computer device 11, peripheral equipment, such as a mouse (not shown) or by using a touch-screen device. Upon performing such operations using the user interface, control commands are wireless transmitted over a control network 12 to a control hub 13 that is connected to the illumination sources 1A-1C and control device 10. The control network 12 may e.g. be a ZigBee network, a DALI network, a DMX network or equivalent. Control hub 13 may be configured for administration of the network of illumination sources 1A-1C. Illumination sources 1A-1C and control device 10 are configured for processing the control commands and adapting their characteristics/settings in accordance with the control commands. Of course, control hub 13 may be bypassed and the illumination sources 1A-1C are controlled directly from the control system 2.

Computer device 11 comprises storage means and a processor (not shown) arranged to store and run computer programs in a manner known to a person skilled in the art. Computer device 11 is provided with one or more computer programs capable of obtaining the functionality described below with reference to FIGS. 3A-3B, 4 and 5. In this embodiment, the software package comprises a Windows-like design environment comprising icons as control items and using a command menu, comprising generally known items such as File, Edit, View etc.

Figure 3:
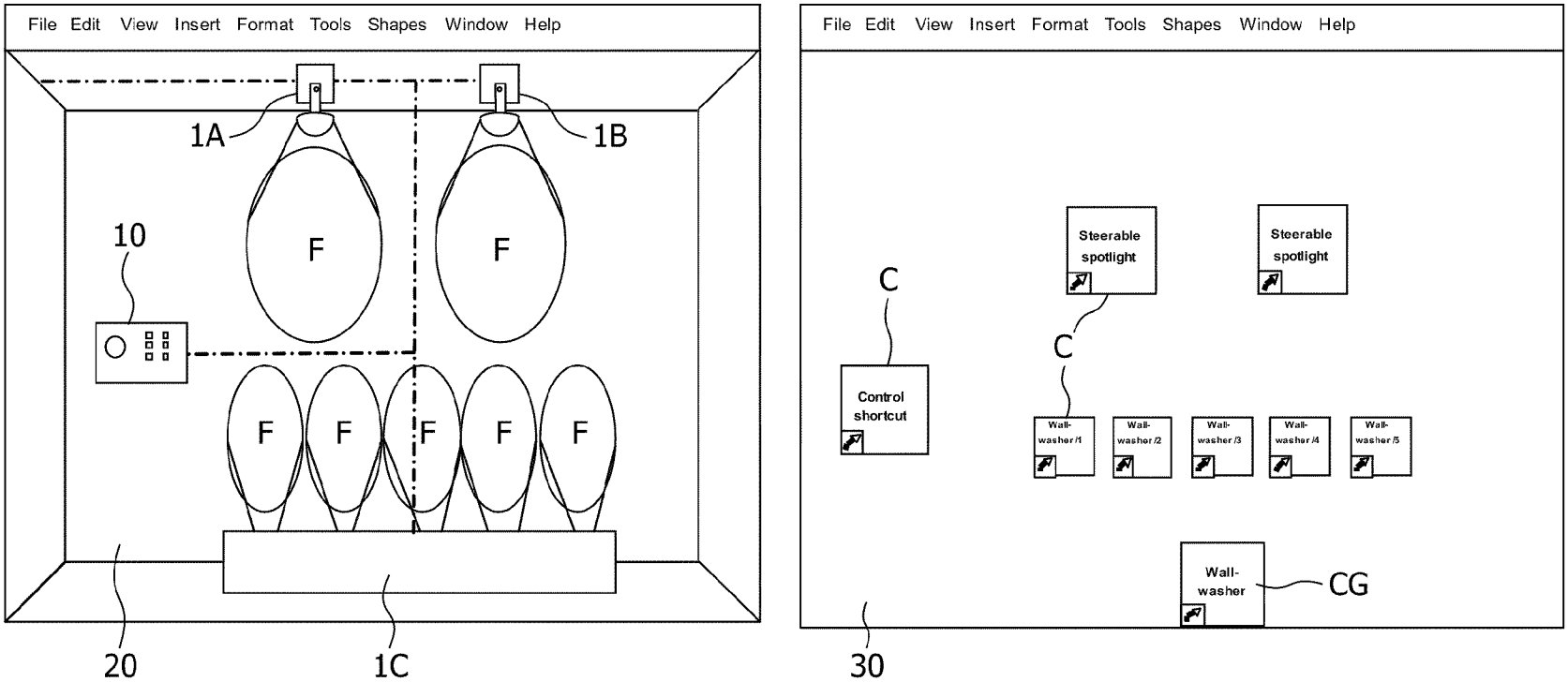
FIGS. 3A and 3B are schematic illustrations of a scene image of the room of FIG. 1 and a control image according to an embodiment of the invention.

Computer device 11 is programmed to register a scene image 20 as illustrated in FIG. 3A using image sensor 4. In the present embodiment, scene image 20 contains an image of both the infrastructural components 1A-1C, 10 of the illumination infrastructure and the footprints F resulting from the light emitted by illumination sources 1A-1C and as such provides a real picture of the infrastructure.

Computer device 11 is also programmed to generate a second picture with control items according to the embodiment described with reference to FIG. 1B, schematically illustrated in FIG. 3B and hereinafter referred to as control image 30. Control image 30 comprises control items C enabling control of the illumination sources 2 and control device 3. In the embodiment of FIG. 3B, the control items are arranged as short-cuts the position of which reflects the relative positions of the illumination sources 1A-1C and control device 10. It is noted in FIG. 3B, the control image 30 comprises a group short-cut CG enabling control all light sources of device 1C and individual short-cuts for controlling each of the light sources separately.

The control image 30 is obtained as follows. The illumination sources 1A-1C in room R each have an identifier ID1-ID3 that can be communicated to the control system 2 in a variety of ways. Illumination sources 1A-1C may comprise an infrared light source (not shown) in order to transmit the identifier to the control system 2. The image sensor array 4 may be used to receive the identifier over the IR link.

In the embodiment of FIG. 2, the identifiers of the illumination sources 1A-1C are embedded within the emitted light, which light is registered by the image sensor array 4. Computer device 11 is programmed to obtain the identifier from the emitted light, thereby allowing a position of a control item C to be assigned to an illumination source 1A-1C.

The above-described embodiments for obtaining the identifier from the illumination sources 2 may also be used to obtain further information, such as control or status information, directly from the illumination sources 1C in order to enable control using control items C.

In an advantageous embodiment, however, at least part of the control information is not received directly from the illumination sources 2, but is retrieved from elsewhere, using the identifier as an index or key for retrieving. The control information may e.g. be stored within the control system 2 and retrieved using the identifier of an illumination source 1A-1C received by the control system 2. The control information may also be obtained externally over a network, e.g. from central hub 12 or over the internet, in response to receiving the identifier and using the identifier for downloading the externally stored control information.

Figure 4:
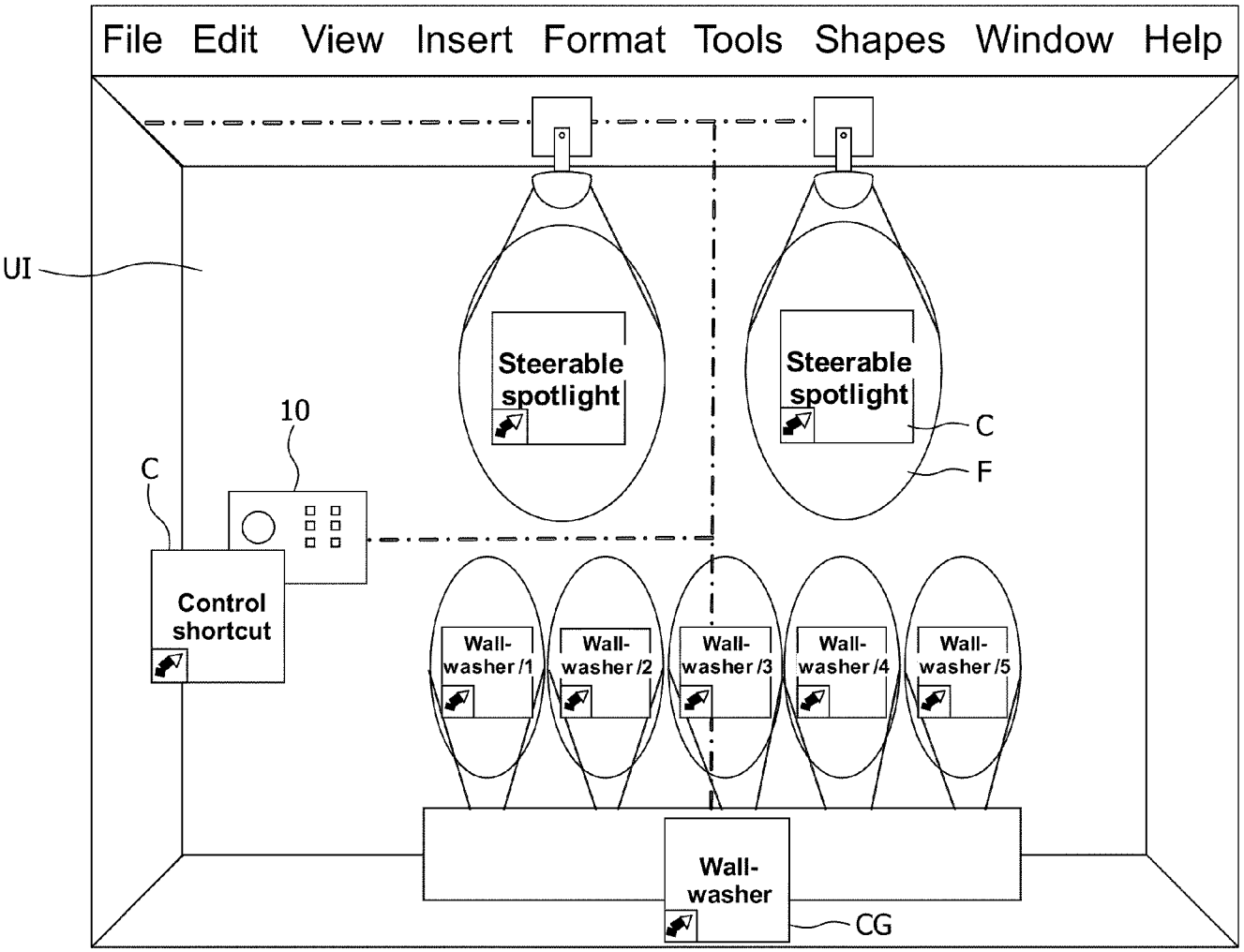
FIG. 4 is a schematic illustration of a user interface wherein the control image of FIG. 3B overlays the scene image of FIG. 3A.

FIG. 4 shows an embodiment of a user interface UI enabling control by a user/designer, wherein scene image 20 and control image 30 have been combined. In particular, control image 30 overlays scene image 20, such that the position of each of the control items C has been assigned to a particular device 1A-1C, i.e. an intuitive pairing is obtained between a control item C and a corresponding illumination source 1A-1C. Such an embodiment provides an intuitive and clear link between the illumination source 1A-1C and the control item C.

The display 3 showing the real scene image 20 of the emitted light in combination with the control image 30 enables the user/designer to control components of the illumination infrastructure by solely operating and looking at the user interface UI. The control image 20, by linking control items C to the devices or footprints F of the scene image 20, a direct insight of the control options of the illumination sources is provided to the user/designer for adapting the light scene. The real scene image 20 may provide immediate feedback on the result of controlling the illumination sources 1A-1C.

If the image sensor array 4 moves to register a different part of the room R (e.g. when the designer is walking around with the control system 2), the view changes of the receiver 4 changes and the displayed control items change accordingly.

Figure 5:
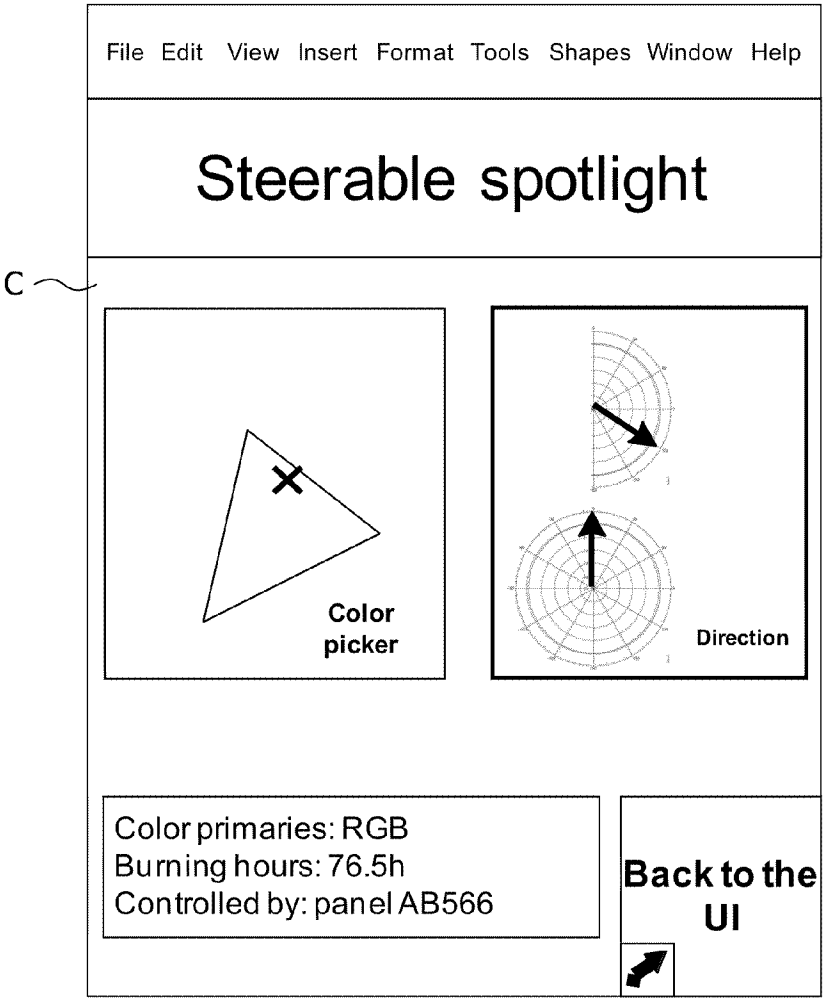
FIG. 5 is a schematic illustration of control information of the user interface of FIG. 4.

The user interface UI comprises one or more selectable shortcuts as control items C. The shortcuts C are configured for providing further control options upon selection of these short-cuts, as illustrated in FIG. 5. The control information behind the short-cut enables the actual control of the illumination sources 1A-1C associated with the short-cut 31, for example selecting a colour point for the illumination source and selecting a direction of the illumination source. From this detailed control information, it is possible to return to the user interface by selecting the appropriate button. In this manner, the control item hides little of the scene image 20 if control of a particular illumination source is not desired, while the control information for controlling the illumination source remains easily accessible by selecting the short-cut C.

The control information may also be represented directly on the scene image 20, i.e. without using short-cuts. Like this, the user/light designer can read the information about the devices and control them directly on the main user interface (without clicking any shortcut icon).

The user interface enables the user/light designer to set the behaviour of each illumination source 1A, 1B, 1C and control device 10 independently. Once all the desired devices are set, the light designer can group all these settings, give it a name and store it in the control system 2 for later use. This is the process to create a (light) scene. More scenes can be created in the manner. In order to allow a simple selection of the scenes without using the control system 2, the user can port the user interface to control device 10. This operation can be performed via the control system 12. Various methods are possible. For example, once a scene is created it is possible to link it to a control device 10 via the control tools on its pop-up window. In another embodiment, it is possible to link a scene to a control device 10 via dragging and dropping the relative devices on top of the (shortcut icon of the) control shortcut.

In another embodiment, once a scene is created, a representative scene icon may appear on the user interface of display 3 of control system 2. In this case, it is possible to link the scene to a control device 10 by dragging and dropping the scene icon on the desired (shortcut icon of the) control shortcut.

In another embodiment, the user/designer can create light effects by selecting zone(s) on the scene image and defining the features (e.g. size, colour, intensity, time variations, etc.) of the desired light effect(s). In one of the embodiments this can be done by drawing a circle around the set of illumination sources 1A-1C to be controlled. A special tool of the editing software package allows this type of approach. In this case, the software program run on the computer device 11 renders the requested light effect by means of intelligent mapping algorithms. These algorithms control the (light) devices in order to optimally render the requested light effect.

The invention claimed is:

1. A control system configured for controlling at least one controllable device, said at least one controllable device being assigned a corresponding identifier and being configured for transmitting an identification signal comprising said corresponding identifier, said control system comprising:

a display for displaying a control item configured for controlling said at least one controllable device, and a receiver configured for wirelessly receiving said identification signal comprising said identifier, wherein said control system is configured for assigning a position of said control item on said display to said at least one controllable device identified by means of said received identifier, wherein said receiver is configured to capture a real-time, real image of at least one of said at least one controllable device or an effect of the at least one controllable device, and wherein said system is configured to overlay said control item on said captured image in said display, and wherein upon said receiver capturing a different real-time, real image of a different at least one controllable device or an effect of said different controllable device, the system is configured to update said display to depict a corresponding control item overlaid on said captured different real-time, real image.

2. The control system according to claim 1, wherein said control system is configured for assigning a selectable position of said control item to said identified device.

3. The control system according to claim 1, said control system being configured for controlling a plurality of distributed controllable devices, said plurality of distributed controllable devices being configured for transmitting corresponding identification signals comprising distinguishable identifiers of said plurality of distributed controllable devices, wherein said receiver is configured for receiving said identification signals and positions of said plurality of distributed controllable devices and wherein said control system is configured for automatically assigning said received positions of said control item on said display to said corresponding plurality of distributed controllable devices identified by said identifiers.

4. The control system according to claim 1, wherein said at least one controllable device comprises an illumination source configured for emitting visible light, said visible light containing said identification signal comprising said identifier, wherein said receiver comprises an image sensor for receiving said identification signal and said control system is configured for assigning said position of said control item on said display to said illumination source identified by means of said received identifier in said identification signal.

5. The control system according to claim 1, wherein said control system is configured for retrieving control information from an internal or external control information source, said control information being related to said device via said identifier, and for linking said control information to said control item on said display.

6. The control system according to claim 1, wherein said control system is configured for controlling said at least one device over a control network, wherein the control system is configured for generating control commands in response to operation of a control item on said display and for transmitting said control commands to said device over said control network.

7. A method of controlling at least one controllable device using a control system, said at least one controllable device being assigned a corresponding identifier and being configured for transmitting an identification signal comprising said corresponding identifier, the method comprising the steps of:

receiving said identifier of said at least one controllable device;

capturing a real-time, real image of at least one of said at least one controllable device or an effect of said at least one controllable device;

assigning a position of a control item on a display of said control system to said at least one controllable device identified by means of said received identifier;

displaying said control item on said position of said display by overlaying said control item on said captured image in said display, said control item being configured for enabling control of said at least one controllable device; and said receiver capturing a different real-time, real image of a different at least one controllable device or an effect of said different controllable device, and the control system updating said display to depict a corresponding control item overlaid on said captured different real-time real image.

8. The method according to claim 7, comprising the step of assigning a selectable position of said control item to said identified device.

9. The method according to claim 7 enabling control over a plurality of distributed controllable devices, said plurality of distributed controllable devices being configured for transmitting corresponding identification signals comprising distinguishable identifiers of said plurality of distributed controllable devices, the method comprising the steps of:

receiving said identification signals and positions of said plurality of distributed controllable devices;

automatically assigning said received positions of said control item on said display to said corresponding plurality of distributed controllable devices identified by said identifiers.

10. The method according to claim 7, wherein said at least one controllable device comprises an illumination source configured for emitting visible light, said visible light containing said identification signal comprising said identifier, the method comprising the steps of:

receiving said identification signal;

assigning said position of said control item on said display to said illumination source identified by means of said received identifier in said identification signal.

11. The method according to claim 7, further comprising the steps of:

retrieving control information from an internal or external control information source, said control information being related to said device via said identifier, linking said retrieved control information to said control item on said display.

12. The method according to claim 7, further comprising the steps of:

generating control commands in response to operation of said control item on said display, and transmitting said control commands to said device over a control network.

* * * * *